US005586653A

United States Patent [19]

Taveroff

[11] Patent Number: 5,586,653

[45] Date of Patent: Dec. 24, 1996

[54] COSMETIC PACKAGE

[75] Inventor: Alan L. Taveroff, Dollard-des-Ormeaux, Canada

[73] Assignee: Canadian Plastics Inc., Lasalle, Canada

[21] Appl. No.: 124,026

[22] Filed: Sep. 21, 1993

Related U.S. Application Data

[63] Continuation-in-part of Ser. No. 949,022, Sep. 21, 1992, abandoned.

[51] Int. Cl.[6] ..... B65D 85/20; A45D 40/20

[52] U.S. Cl. ..... 206/362; 132/295; 132/297; 132/316; 132/318; 206/229; 206/385; 206/581

[58] Field of Search ..... 206/235, 229, 206/362, 15.2, 581, 443, 472, 475; 132/318, 297, 296, 315, 295, 316, 317, 320

[56] References Cited

U.S. PATENT DOCUMENTS

| | | | |
|---|---|---|---|
| 1,229,286 | 6/1917 | Kendall . | |
| 1,484,770 | 2/1924 | Goertz | 132/295 |
| 1,503,979 | 8/1924 | Callahan . | |
| 1,528,645 | 3/1925 | Wilson . | |
| 2,321,462 | 6/1943 | Conant | 132/318 X |
| 2,775,249 | 12/1956 | Morrell . | |
| 3,911,936 | 10/1975 | Kingsford . | |
| 3,976,195 | 8/1976 | Cohen . | |
| 4,337,859 | 7/1982 | Murphy et al. . | |
| 4,471,874 | 9/1984 | Morane | 206/581 |
| 4,524,871 | 6/1985 | Klinger . | |
| 4,562,923 | 1/1986 | Katada et al. . | |
| 4,573,569 | 3/1986 | Parker | 206/362 |
| 4,687,099 | 8/1987 | Van Buuren . | |
| 4,714,160 | 12/1987 | Bennett . | |
| 4,815,608 | 3/1989 | Silberberg . | |
| 4,901,848 | 2/1990 | Parre . | |
| 5,007,531 | 4/1991 | Lighten | 206/581 |
| 5,348,031 | 9/1994 | Cloud | 132/317 |

FOREIGN PATENT DOCUMENTS 8603659 7/1986 WIPO .

*Primary Examiner*—Bryon P. Gehman
*Attorney, Agent, or Firm*—Swabey Ogilvy Renault

[57] ABSTRACT

A cosmetic package includes an open-top casing, a closure and a tray pivotally mounted to opposite sides of the casing, with the tray removably carrying a plurality of elongated sticks each coated at one end with a cosmetic product, such as lipstick, nail polish or eye make-up. The elongated sticks can also take the form of make-up pencils. The tray includes a pair of parallel and spaced apart notched members, with the notches of one member being aligned with respective notches of the other member, whereby each pair of aligned notches cooperate for retaining one elongated stick. The elongated sticks are carried on the underside of the tray when it is retracted in the casing. Aligned openings are defined in the closure and in the tray for viewing the coated ends of the sticks when the package is closed. The opening of the closure is fitted with a protective window. Stoppers and transverse elongated support members are provided in the casing and on the underside of the tray in order to secure the sticks in place thereby preventing smearing of the coated ends of the sticks. The package is made from a plastics material and integral hinges connect the casing to both the closure and the tray. Upon release of the closure from the casing, both the closure and the tray spring up away from the casing.

20 Claims, 4 Drawing Sheets

COSMETIC PACKAGE

CROSS-REFERENCE

This application is a continuation-in-part of U.S. Ser. No. 07/949,022 filed Sep. 21, 1992, now abandoned.

BACKGROUND OF THE INVENTION

1. Field of the Invention

The present invention relates to cosmetic packages and, more particularly, to a package for holding a series of sticks provided with a cosmetic product.

2. Description of the Prior Art

Various prior art cosmetic packages have already been proposed. For instance, U.S. Pat. No. 4,687,099 issued to Van Buuren on Aug. 18, 1987 discloses a package for sticks each having a head portion coated with a cosmetic product. The package includes a sliding tray having upstanding side walls of which two opposite walls are provided with an incision so that one part of the sliding tray can pivot with respect to the other part of the sliding tray. The cosmetic sticks are releasably attached to the sliding tray which is inserted in a wrapper. Therefore, slidably removing the tray from the wrapper at least until the incision allows one part of the sliding tray to pivot with respect to the other will partially reveal the sticks for easier removal thereof from the other part of the tray. The means used for holding the cosmetic sticks in place in the tray include, for instance, a piece of corrugated cardboard or a piece of molded plastic defining a series of grooves of widths corresponding to the diameters of the sticks thereby allowing the cosmetic sticks to be removably attached to the sliding tray.

U.S. Pat. No. 2,775,249 issued on Dec. 25, 1956 to Morrell discloses a matchbook-type cosmetic package which consists of a base sheet, a cover integral with the base sheet and foldable thereover, and a lip which is preferably an extension of the base and which folds rearwards to hold the cover in position when it is closed. Rods which are tipped with lip rouge are inserted in pockets formed by the use of fastening means, such as staples. A powder puff or pad is carried inside the package, preferably in an envelope.

U.S. Pat. No. 3,976,185 issued on Aug. 24, 1976 to Cohen discloses an improved sealed package which includes one or more disposable handled swabs or applicator sticks and a medicinal material to be applied by the heads of the swabs or applicator sticks. The package has the form of a tray molded in such a way as to provide for each applicator stick a well that serves loosely to receive the head portion thereof and isolate it from external compression forces. An inclined support ledge positions the handle portion of each applicator stick so it is inclined upwardly and away from the well. A cover sheet made of a gas-impervious material is secured over the tray to provide a gas-tight seal that is selectively openable to provide access to the swabs or applicator sticks. The handles of the swabs are preferably engaged and depressed by the cover sheet to hold the swabs securely within the package.

U.S. Pat. No. 4,337,859 issued on Jul. 6, 1982 to Murphy et al discloses a method for producing a cosmetic product containing an integrally molded powder cake. The product includes a casing having an open top enclosed by a cover with the casing defining a cavity to contain the powder cake. In the method, with the cover closed, the casing in inverted and a slurry is introduced into the cavity through an opening in the bottom of the casing. Once cooled, the slurry forms the powder cake.

Finally, U.S. Pat. No. 4,714,160 issued on Dec. 22, 1987 to Bennett teaches a dispenser which comprises a horizontally elongated base having first and second opposite flat surfaces. A plurality of spaced elongated rods are each secured at one end thereof by an integral short thin prong to the first surface and extend outward in a common direction at right angles to the base. The opposite end of each rod has a coating. An elongated support member is disposed in a plate parallel to the common plate of the rods while being spaced from the articles and being secured at one end to the base- A horizontal elongated plate parallel to the base and secured at one of the elongated edges to the other end of the member is disposed adjacent but spaced from the coated ends of the rods. First and second elongated article support elements contact the rod and are secured to the support member. The parallel support members each define straight parallel grooves which are disposed side by side and in alignment with each other for detachably carrying the rods. A transparent plastic hollow cover detachably engages the base to enclose the elongated rods while being spaced therefrom.

SUMMARY OF THE INVENTION

It is therefore an aim of the present invention to provide an improved cosmetic package.

It is also an aim of the present invention to provide a cosmetic package comprising an open-ended box-like casing, a closure for the casing pivoted at one end thereof, and a tray also pivotally mounted to the casing and detachably carrying thereon a series of cosmetic sticks.

It is a further aim of the present invention to provide a cosmetic package adapted to protect the cosmetic sticks and thus prevent the smearing thereof inside the cosmetic package and, more particularly, inside the casing and the tray thereof.

Therefore, in accordance with the present invention, there is provided a package comprising a plurality of elongated sticks, an open-top casing means including a bottom wall and side walls extending upwards therefrom, a closure means pivotally mounted to one of the side walls, a tray means pivotally mounted to another one of the side walls. The tray means is adapted for detachably carrying thereon the elongated sticks and for retracting, in a closed position thereof, in the casing means with the closure means being adapted, in a closed position thereof, for covering the open top of the casing means. Therefore, the tray means and the elongated sticks are enclosed within the casing means and the closure means in the above closed positions.

In a more specific construction in accordance with the present invention, the tray means comprises on an underside thereof facing, in the closed position of the tray means, the bottom wall of the casing means at least a pair of spaced apart elongated notched members each defining a series of notch means, with each notch means of one of the elongated notched members cooperating with a respective notch means of the other one of the elongated notched members for detachably carrying an elongated stick.

Also, stop means are provided in the casing means for limiting the downwards pivot of the tray means therein in the closed position thereof.

Furthermore, a first opening is defined in the tray means which is in substantial alignment with a second opening defined in the closure means, when in the aforementioned closed positions thereof, for viewing at least parts of the elongated sticks when the package is closed.

Preferably, a clear window is mounted to the second opening for isolating the elongated sticks when the package is closed.

In a specific construction, the casing means, the closure means and the tray means are all made of a plastics material. Also, integral plastic first and second hinge means pivotally join the casing means respectively with the closure means and with the tray means on opposite side walls of the casing means.

Moreover, the closure means includes a ledge means extending from a front edge thereof and defining at least one inwardly projecting tab means for cooperating with the second hinge means for maintaining the closure means clipped to the casing means in the closed position thereof.

Preferably, the closure means springs up at least partly when the tab means are released from for engagement with the second hinge means facilitating the grasping of the closure means.

Also, a mirror is provided on at least one of an underside of the closure means and on an upper surface of the bottom wall of the casing means. Preferably, the mirror is adhesively mounted to the package.

In all constructions, the elongated sticks may consist of cosmetic sticks each having a handle portion adapted to be removably attached to the elongated notched members and a head portion provided with at least one cosmetic product and adapted to be viewed through the window, when the package is closed.

Also in accordance with the present invention, there is provided a package comprising a plurality of elongated sticks, an open-top casing means, a closure means and a tray means both pivotally mounted to the casing means, the tray means being adapted for detachably carrying thereon the elongated sticks and for retracting, in a closed position thereof, in the casing means with the closure means being adapted, in a closed position thereof, for covering the open top of the casing means, whereby the tray means and the elongated sticks are enclosed within the casing means and the closure means in the closed positions, the closure means being adapted for allowing at least parts of the elongated sticks to be viewed when the package is closed.

DESCRIPTION OF THE PREFERRED EMBODIMENTS

Figure 1:
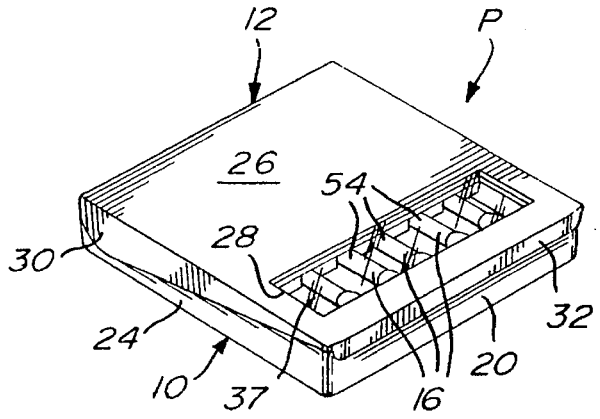
FIG. 1 is a perspective view of a cosmetic package in accordance with the present invention, shown in its closed position.
Figure 2:
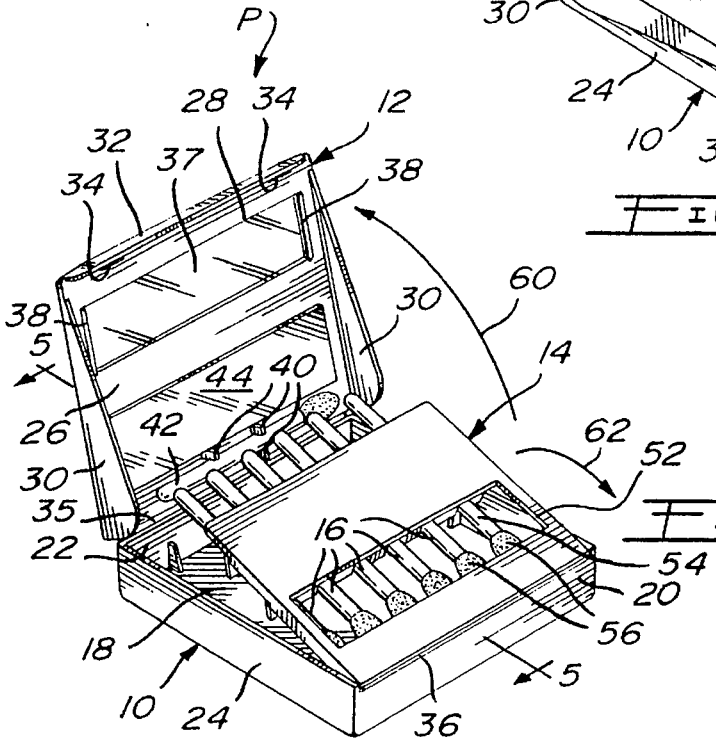
FIG. 2 is a perspective view of the cosmetic package of FIG. 1 but shown in a partly open position, wherein a cover of the cosmetic package is open.
Figure 3:
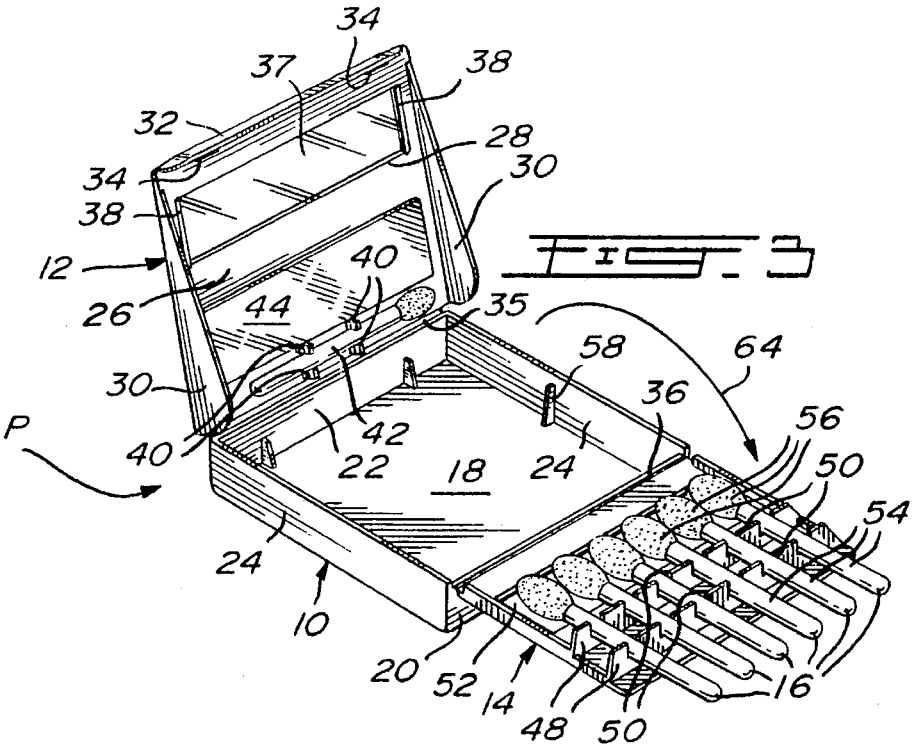
FIG. 3 is a perspective view of the cosmetic package of FIGS. 1 and 2 but shown in a fully open position, that is with the cover and a tray thereof being open.

In accordance with the present invention, FIGS. 1 to 6 illustrate a cosmetic package P which basically comprises an open-ended box-like casing 10, a closure 12 pivotally mounted to the casing 10, and a tray 14 also pivotally mounted to the casing 10 and adapted for detachably carrying thereon a series of cosmetic sticks 16. More particularly, as best seen in FIG. 3, the casing 10 includes a bottom wall 18 of rectangular and almost square configuration and peripheral walls which extend upwardly at right angles therefrom and which include a front wall 20, a rear wall 22, and a pair of side walls 24 extending parallel between the front and rear walls 20 and 22.

The closure 12 includes a rectangular or square wall 26 which is slightly larger than the transverse dimensions of the casing 10 and which is pivotally mounted at a rear peripheral edge thereof to the upper free edge of the rear wall 22 of the casing 10. The tray 14 is pivotally mounted to the upper free edge of the front wall 20 of the casing 10. The closure 12 defines a rectangular opening 28 near a front peripheral edge thereof. The main wall 26 of the closure 12 includes a pair of parallel side walls 30 extending downwardly at right angles therefrom. A short elongated ledge 32 extends downwardly at right angles from the front peripheral edge of the main wall 26 of the closure 12. This ledge 32 defines a pair of inwardly projecting tabs 34. When the tray 14 is in a closed position (FIGS. 1, 4 and 6), that is when it is in the casing 10, the closure 12 can be lowered on the casing 10 and just above the tray 14 for closing the cosmetic package P. The pair of tabs 34 of the front ledge 32 of the closure 12 will engage under the hinge defined at the pivot of the tray 14 with the casing 12, with the side walls 30 of the closure 12 being disposed laterally on each side of the side walls 24 of the casing 10.

It is noted that the closure 12 can be pivotally mounted to any one of the peripheral walls 20, 22 and 24 of the casing 10, with the tray 14 being pivotally mounted to any one of the remaining peripheral walls thereof. Therefore, the closure 12 and the tray 14 can be pivotally mounted to a pair of opposite walls of the casing 10 or to a pair of adjoining walls thereof.

Figure 5:
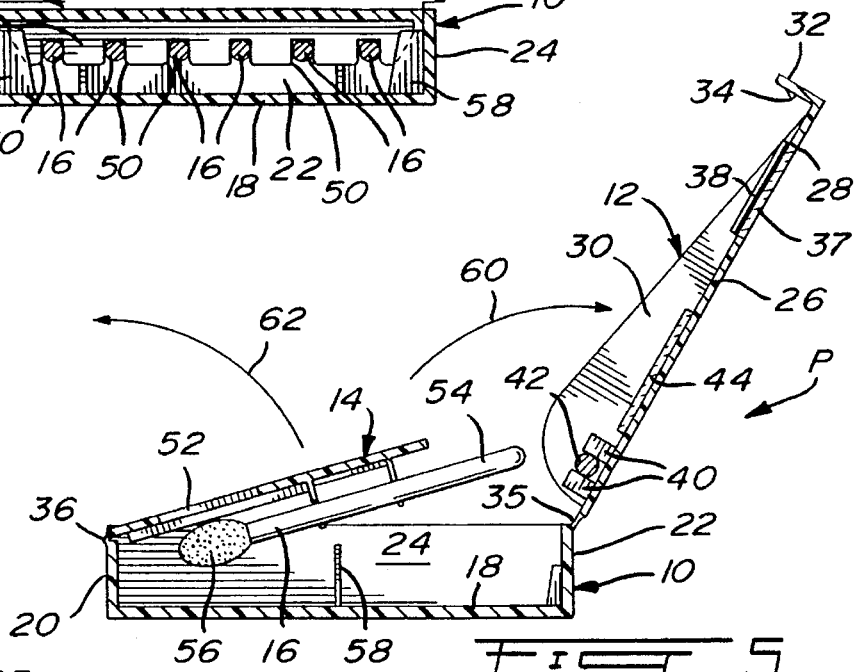
FIG. 5 is a longitudinal cross-sectional view taken along lines 5—5 of FIG. 2.

It is also noted that the casing 10, the closure 12 and the tray 14 are all made of a plastics material with the pivotal connection therebetween being assumed by partly weakened connections between the integrally joined casing 10, closure 12 and tray 14. Accordingly, hinges 35 and 36 respectively join the casing 10 with the closure 12 and with the tray 14, as best seen in FIG. 5.

The rectangular opening 28 is provided with a window 37 which is maintained in position by a pair of short angular flanges or lips 38 (see FIGS. 2 to 4) defined along the short longitudinal edges of the rectangular opening 28. Adjacent the hinge 35 defined at the junction of the casing 10 with the closure 12, there are provided on the main wall 26 of the closure 12 two pairs of spaced apart arms 40 which extend at right angles therefrom towards the bottom wall 18 of the casing 10 when the closure 12 is in its closed position, as best seen in FIGS. 3 and 5. The pairs of arms 40 are adapted to removably retain an applicator 42 under the closure 12. A mirror 44 is adhesively mounted to the main wall 26 of the closure 12 between the window 37 and the applicator 42 thereof. The mirror 44 can be used for applying the make-up when the closure is in its open position.

The tray 14 is pivotally connected to the upper edge of the front wall 20 of the casing 10 by the integral hinge 36. Now referring to FIGS. 3 and 4, the tray 14 includes on its underside (when considered or viewed in its retracted position in the casing 10) a pair of parallel elongated members 48 which extend transversely on the tray 14 and at right angles thereto. The elongated members 48 each defines a series of spaced apart rectangular notches 50 with each notch of one of the elongated members 48 being longitudinally aligned with a respective notch of the other one of the elongated member 48. Accordingly, each pair of aligned notches 50 of the elongated members 48 is adapted to removably receive one of the cosmetic sticks 16 due at least to the friction forces therebetween.

Figure 6:
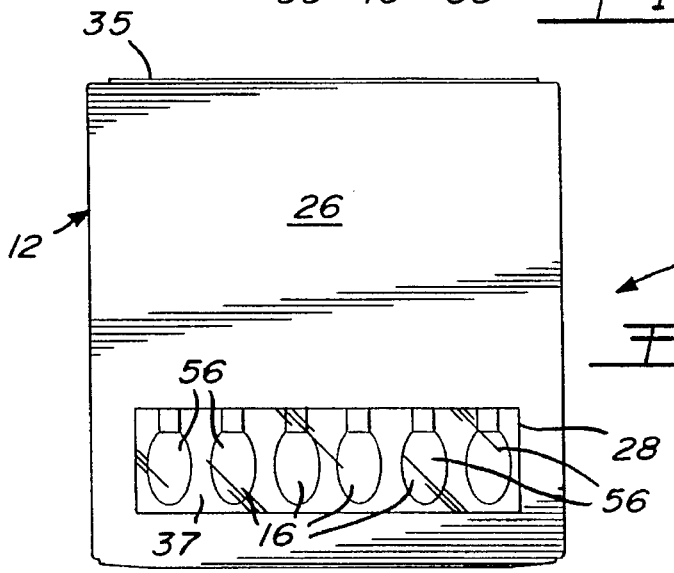
FIG. 6 is a top plan view of the cosmetic package of FIG. 1.

The tray 14 defines a rectangular opening 52 (see FIG. 2) which is of dimensions similar to those of the rectangular opening 28 and thus of the window 37 of the closure 12 and which is aligned therewith when both the tray 14 and the closure 12 are in their respective closed positions shown in FIGS. 1 and 6.

As best seen in FIGS. 3 and 5, the cosmetic sticks 16 each include an elongated handle portion 54 of circular cross-section and, at one end thereof, a head portion 56 consisting of the cosmetic product intended to be applied by the user. The cosmetic sticks 16 are removably mounted in the notches 50 of the elongated members 48 by their respective handle portion 54 in order that the head portions 56 thereof are framed within the rectangular opening 52 of the tray 14, as seen in FIG. 6. Therefore, when the cosmetic package P is in its closed position illustrated in FIGS. 1 and 6, the cosmetic coated head portions 56 of the sticks 16 can be seen through the window 37 of the closure 12.

Figure 4:
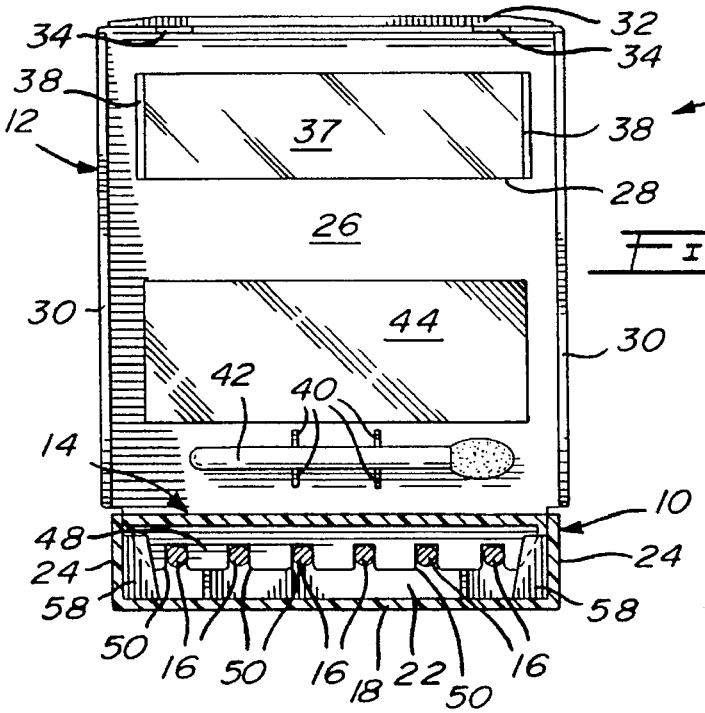
FIG. 4 is a transversal cross-sectional view of the cosmetic package, shown with its tray fully retracted in the casing and its cover in extended open position.

As best seen in FIGS. 3 and 4, in order to limit the downwards pivot of the tray 14 in the casing 10, a pair of stoppers 58 extend upwards from the bottom wall 18 of the casing 10 and near the middle of the side walls 24 thereof. Therefore, when the tray 14 is downwardly pivoted in the casing 10, the longitudinal edges of the tray 14 abut the upper ends of the stoppers 58, whereby the cosmetic sticks 16 extend substantially parallel between the bottom wall 18 of the casing 10 and the main wall 26 Of the closure 12 while being spaced therefrom and from the tray 14 in order to prevent smearing of the cosmetic coated head portions 56 of the sticks 16.

The rectangular notches 50 are obviously sized in accordance with the diameter of the handle portions 54 of the cosmetic sticks 16.

When the closure 12 is pivoted away from the casing 10 along the direction of arrows 60 of FIGS. 2 and 5, the resiliency in the plastic hinge 36 causes the tray 14 to automatically spring up (as per arrows 62) in such a way that the longitudinal side edges thereof and the free rear edge thereof are no longer encased within the casing 10 thereby facilitating the further outwards pivot or opening of the tray 14 (see arrow 64 of FIG. 3) with respect to the casing 10 with a view of retrieving the cosmetic sticks 16. Resiliency in the hinge 35 which connect the casing 10 to the closure 12 can also cause the closure 12 to spring upwards along arrow 60 when the tabs 34 are released from engagement with the ledge 32 of the closure 12.

Figure 7:
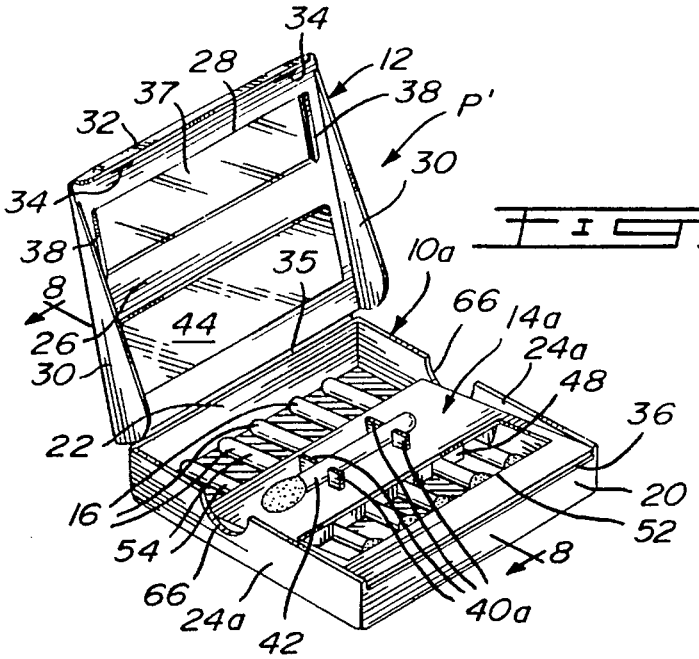
FIG. 7 is a perspective view similar to FIG. 2 but showing a first variant of a cosmetic package in accordance with the present invention.

FIGS. 6 and 7 illustrate a variant P' of the cosmetic package P of FIGS. 1 to 6 in which the casing 10*a* includes longitudinal side walls 24*a* which define a pair of cut-outs 66 for allowing the user to grasp the tray 14*a* when it is retracted in the casing 10*a* thereby facilitating its removal therefrom (along arrow 68 of FIG. 8) in the cases in which there is no resiliency (or there is a loss of resiliency) in the hinge 36 to cause the tray 14*a* to spring up once the closure 12 is pivoted outwards of the casing 10*a*.

Figure 8:
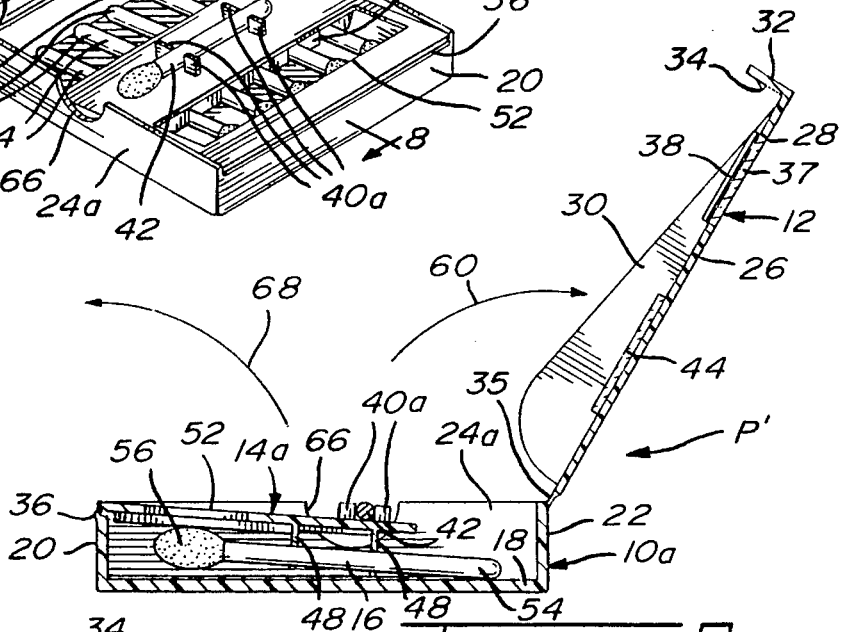
FIG. 8 is a longitudinal cross-sectional view taken along lines 8—8 of FIG. 7.

Also, the casing 10*a* of the cosmetic package P' of FIGS. 7 and 8 does not include the stoppers 58 of the cosmetic package of FIGS. 1 to 6, whereby the downwards pivot of the tray 14*a* in the casing 10*a* is limited by the ends of the handle portions 54 of the cosmetic sticks 16 which abut the upper surface of the bottom wall 18 of the casing 10*a*.

Furthermore, the applicator 42 of the cosmetic package P' is maintained in position by two pairs of spaced apart arms 40*a* which extend upwards from the upper surface of the tray 14*a* next to the rectangular opening 52 thereof.

Figure 9:
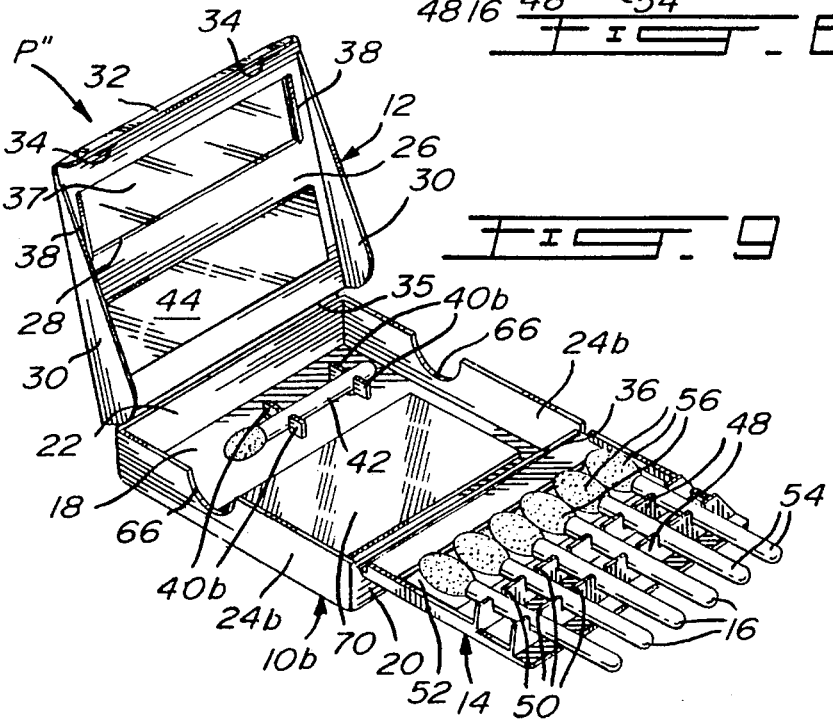
FIG. 9 is a perspective view similar to FIG. 3 but showing a second variant of a cosmetic package in accordance with the present invention.

Now referring to FIG. 9, a further cosmetic package P" in accordance with the present invention has its applicator 42 retained by two pairs of spaced apart arms 40*b* which extend from the upper surface of the bottom wall 18 of the casing 10*b*, with a mirror 70 being disposed on the bottom wall 18 of the casing 10*b*. The longitudinal side walls 24*b* of the casing 10*b* of the cosmetic package P" defines cut-outs 66 such as those of the cosmetic package P' of FIGS. 7 and 8.

It is noted that the applicator 42 is provided in the cases wherein the cosmetic product which coats the head portions 56 of the sticks 16 is for application to the eyes. In the cases where the cosmetic product is intended for the lips or for the nails, no such applicator 42 is required. Finally, the window 37 can be clipped to the closure 12, as described hereinabove by way of the flanges or lips 38, or it can be heat sealed thereto.

Figure 10:
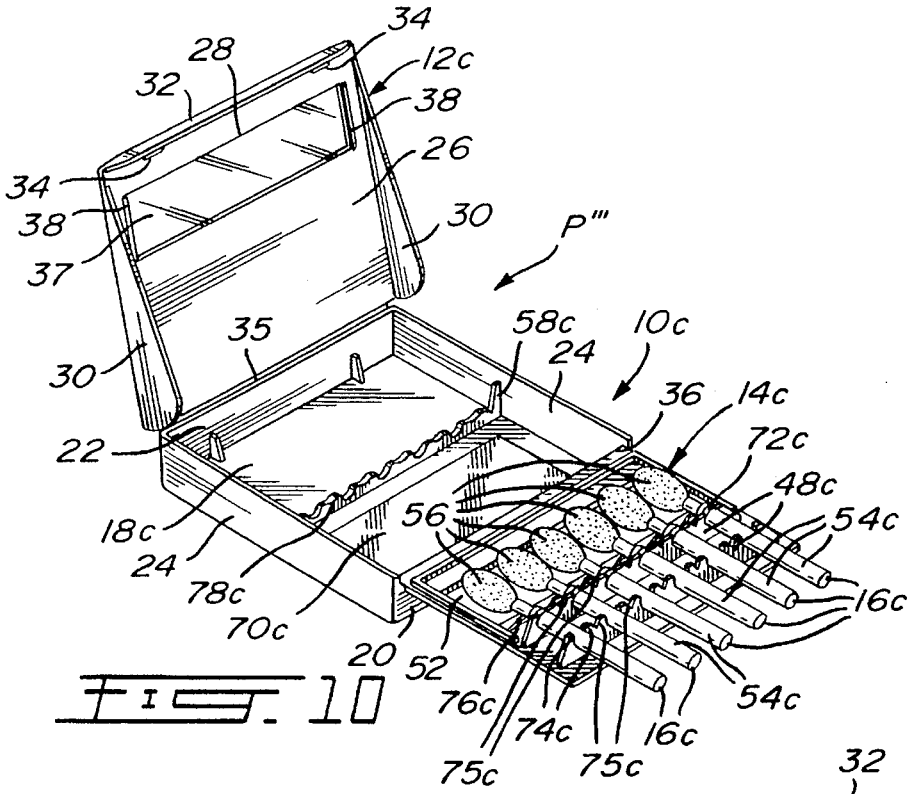
FIG. 10 is a perspective view similar to FIG. 3 but showing a third variant of a cosmetic package in accordance with the present invention.
Figure 11:
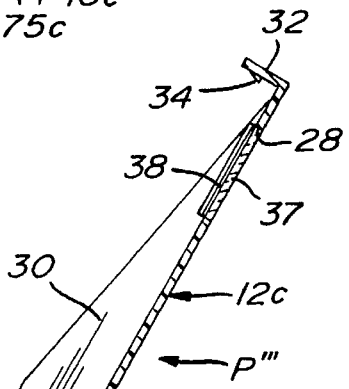
FIG. 11 is a central longitudinal cross-sectional view of the cosmetic package of FIG. 10 but shown in a partly open position, wherein a cover of the cosmetic package is open.
Figure 12:
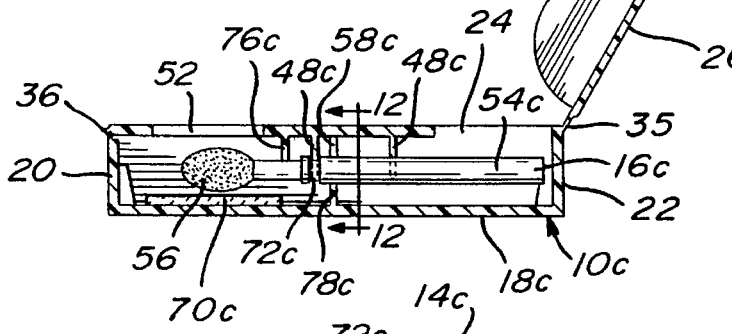
FIG. 12 is a cross-sectional view taken along lines 12—12 of FIG. 11 and showing the position of the cosmetic sticks with respect to a bottom wall of a casing when a tray of the cosmetic package is in a closed position thereof.
Figure 12:
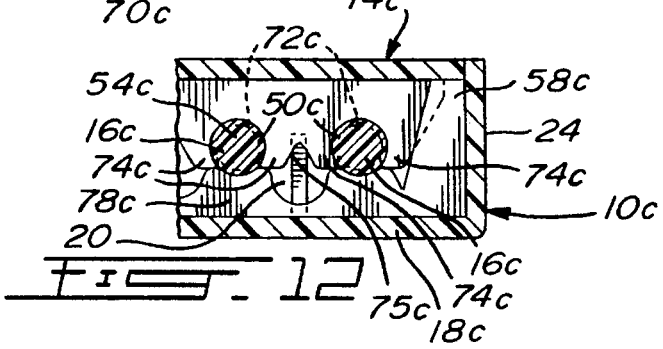

FIGS. 10 to 12 illustrate another cosmetic package P'" in accordance with the present invention which is similar to the cosmetic package P of FIGS. 1 to 6 although, as illustrated, the package P'" does not comprise the mirror 44 and the applicator 42 of package P. As in the cosmetic package P" of FIG. 9, the package P'" includes a mirror 70*c* at the bottom of the casing 10*c*. In any event, the major differences of the cosmetic package P'" of FIGS. 10 to 12 lie in the cosmetic sticks 16*c* and in the means of attachment thereof to the tray 14*c*.

The cosmetic package P'" comprises a casing 10*c* with a closure 12*c* and a tray 14*c* being hingedly mounting to upper opposite edges thereof. The following elements of package P'" are substantially identical to corresponding features of the cosmetic package P of FIGS. 1 to 6: the front, rear and side walls 20, 22 and 24 of the casing 10*c*; the main wall 26, the opening 28, the pair of side walls 30, the ledge 32, the tabs 34, the window 37 and the lips 38, all comprised in the closure 12*c*; the hinges 35 and 36 joining the casing 10*c* respectively to the closure 12*c* and to the tray 14*c*; and the opening 52 of the tray 14*c*.

Each cosmetic stick 16*c* comprises an elongated handle 54*c* and a cosmetic-covered head portion 56 of smaller diameter than the handle 54*c*.

The handle 54*c* defines near the head portion 56 a circumferential annular groove 72*c*.

The tray 14*c* comprises a pair of parallel and spaced apart elongated members 48*c* which extend transversely along the underside of the tray 14*c* when in its closed position of FIGS. 11 and 12. Each elongated member 48*c* defines a series of notches 50*c* each having the outline of a circle missing a segment, whereby the elongated member 48*c* defines adjacent each notch 50*c* a pair of inwardly extending arms 74*c* for clippingly retaining the handles 54*c* of the cosmetic sticks 16*c* in the notches 50*c* and thus to the tray 14*c*. As in the prior embodiments, the notches 50*c* of both the elongated members 48*c* are disposed longitudinally opposite one another, whereby each set of facing notches 50*c* can hold one of the cosmetic sticks 16*c*. The notches 50*c* of the elongated member 48*c* which is located adjacent the opening 52 of the tray 14*c* are smaller than those of the other elongated member 48*c* for receiving the annular grooves 72*c* defined in the handles 54*c* of the cosmetic sticks 16*c*. V-shaped notches 75*c* are defined between the stick receiving notches 50*c* for allowing some resilient displacement or flexion of the arms 74*c* when the cosmetic sticks 16*c* are snapped onto the tray 14*c* or are removed therefrom.

A first elongated support member 76*c* extend transversely on the tray 14*c* between the opening 52 and the elongated members 48*c* for supporting the cosmetic sticks 16*c* (and thus preventing a pivot thereof) at the head portions 56 thereof, that is between the cosmetic which coats part of each head portion 56 and the handle 54*c*. A similar second elongated support member 78*c* extends transversely on a bottom wall 18*c* *of* the casing 10*c* for further supporting the cosmetic sticks 16*c* at a location on the handles 54*c* opposite and between the pair of elongated members 48*c* when the cosmetic package is in its closed position. The elongated members 48*c* in concert with the first and second support members 76*c* and 78*c* secure the cosmetic sticks 16*c* to the tray 14*c* of the cosmetic package P''' which, for instance, prevents the smearing in the casing 10*c* of the cosmetic provided on the head portions 56 of the cosmetic sticks 16*c*.

The second support member 78*c* defines at the ends thereof a pair of stoppers 58*c* which limit by abutment the downwards pivot of the tray 14*c* into the casing 10*c* and thus prevent the smearing of the head portions 56 on the bottom wall 18*c* of the casing 10*c*.

In all embodiments, an overwrap may cover the entire closed cosmetic packages to preserve freshness of the cosmetic provided on the cosmetic sticks enclosed therein.

I claim:

1. A package comprising a plurality of elongated sticks, a casing comprising peripheral walls defining an open top, a closure and a tray each pivotally mounted to said casing, said tray having attachment means detachably carrying the elongated sticks on said tray and said tray being adapted for retracting, in a closed position thereof, within said casing with said closure being adapted, in a closed position thereof, for covering said open top of said casing, said tray and the elongated sticks being substantially enclosed within said casing and said closure in said closed positions, the elongated sticks being carried on an underside of said tray when said tray is in said closed position thereof such that said tray extends intermediate said elongated sticks and said closure with said elongated sticks extending in a plane substantially parallel to said underside of said tray.

2. A package as defined in claim 1, further comprising viewing means substantially opposite at least part of the elongated sticks such that the elongated sticks are at least partly visible when the package is closed.

3. A package as defined in claim 2, wherein said casing comprises a bottom wall and side walls extending upwards therefrom, said attachment means comprising at least a pair of spaced apart elongated notched members each defining a series of notches, with each notch of one of said elongated notched members cooperating with a respective notch of the other one of said elongated notched members for detachably carrying one of the elongated sticks.

4. A package as defined in claim 3, wherein said notched members are parallel and extend at right angles from said tray, the notches of both said notched members being aligned in pairs, and wherein said notches each comprise a pair of cooperating resilient arms for allowing the elongated sticks to be snapped into engagement with said notched members, the elongated sticks each defining a circumferential groove adapted to engage a respective notch of one of said notched members, whereby a proper positioning of the elongated sticks on said tray is ensured.

5. A package as defined in claim 3, wherein said casing, said closure and said tray are all made of a plastics material, integral plastic first and second hinges pivotally joining said casing respectively with said closure and with said tray and wherein said casing, said closure and said tray are each of rectangular shape, with said closure and said tray being pivotally connected to opposite side walls of said casing, said closure including a ledge extending from a front edge thereof and defining at least one inwardly projecting tab for cooperating with said second hinge for maintaining said closure clipped to said casing in said closed position thereof.

6. A package as defined in claim 5 wherein said closure springs up at least partly when said tab is released from engagement with said second hinge for facilitating the grasping of said closure.

7. A package as defined in claim 3, wherein cutouts are defined on the side walls of said casing located on each side of said tray and of a connection thereof with said casing for facilitating the grasping of said tray for the further manipulation thereof.

8. A package as defined in claim 3, wherein a mirror is provided on at least one of an underside of said closure and on an upper surface of said bottom wall of said casing and, when provided on said upper surface of said bottom wall at least partly opposite said viewing means.

9. A package as defined in claim 3, wherein means for releasably carrying an applicator are provided on at least one of an underside of said closure, an upper surface of said tray and an upper surface of said bottom wall of said casing.

10. A package as defined in claim 2, wherein support members are provided in at least one of said bottom wall of said casing and said tray, said support members securing by abutment the elongated sticks in said tray when said closure and said tray are in said closed positions thereof, and wherein stoppers are provided in said casing for limiting the downwards pivot of said tray therein in said closed position thereof.

11. A package as defined in claim 2, wherein said tray springs up at least partly from said casing when said closure is opened for facilitating the grasping of said tray for the further manipulation thereof.

12. A package as defined in claim 2, wherein the elongated sticks consist of cosmetic sticks each having a handle portion adapted to be removably attached to said tray and a head portion provided with at least one cosmetic product at least partly opposite said viewing means when the package is closed.

13. A package as defined in claim 2, wherein said viewing means comprise a first opening defined in said closure and a second opening defined in said tray, said second opening being at least partly aligned with said first opening when in said closed positions thereof, the elongated sticks extending at least partly opposite said first and second openings and thus being at least partly visible when the package is closed through said first and second openings.

14. A package as defined in claim 13 wherein a clear window is mounted to said first opening, said clear window allowing the elongated sticks to be viewed when the package is closed while also isolating the elongated sticks from the outside when the package is closed.

15. A package as defined in claim 14, wherein said first and second openings are rectangular, and wherein said closure defines a pair of flanges on two opposite sides of said first opening for holding said window thereon.

16. A package comprising a plurality of elongated sticks, a casing, a closure, and a tray displaceably mounted to said casing, said tray having attaachment means detachably carrying the elongated sticks on said tray and said tray being adapted for retracting, in a closed position thereof, within said casing with said closure being adapted, in a closed position thereof, for substantially enclosing said tray in its said closed position and the elongated sticks within said casing, the elongated sticks being carried on an underside of said tray when said tray is in said closed position thereof, said closure and said tray including viewing means provided substantially perpendicularly opposite a plane defined by the elongated sticks for allowing at least part of the elongated sticks to be viewed when the package is closed.

17. A package as defined in claim 16, wherein said viewing means comprise a first opening defined in said closure and a second opening defined in said tray, said second opening being at least partly aligned with said first opening when in said closed positions thereof, the elongated sticks extending at least partly opposite each of said first and second openings and thus being at least partly visible when the package is closed through said first and second openings.

18. A package as defined in claim 17, wherein a clear window is mounted to said first opening, said clear window allowing the elongated sticks to be viewed when the package is closed while also isolating the elongated sticks from the outside when the package is closed.

19. A package as defined in claim 16, wherein the elongated sticks consist of cosmetic sticks each having a handle portion adapted to be removably attached to said tray and a head portion provided with at least one cosmetic product at least partly opposite said viewing means, when the package is closed.

20. A package as defined in claim 16, wherein a mirror is provided in said casing such that the elongated sticks extend between said tray and said mirror, said mirror extending at least partly opposite said viewing means.

* * * * *